US010961847B2

(12) United States Patent
Varela et al.

(10) Patent No.: US 10,961,847 B2
(45) Date of Patent: Mar. 30, 2021

(54) ACOUSTIC FLOW METER TOOL AND RELATED METHODS

(71) Applicant: ENG+RD, LLC, La Jolla, CA (US)

(72) Inventors: Reinaldo Varela, Calgary (CA); Mauricio Rojas, Houston, TX (US); Zenir Viero, Houston, TX (US); Diana Lorena Mendez, Bogata (CO); Juan Carlos de los Rios, Bogota (CO); Andrea J. Ortega, Bogota (CO)

( * ) Notice: Subject to any disclaimer, the term of this patent is extended or adjusted under 35 U.S.C. 154(b) by 0 days.

(21) Appl. No.: 15/585,070

(22) Filed: May 2, 2017

(65) Prior Publication Data

US 2018/0320511 A1 Nov. 8, 2018

(51) Int. Cl.

| | |
|---|---|
| ***E21B 47/18*** | (2012.01) |
| ***E21B 49/08*** | (2006.01) |
| ***E21B 47/14*** | (2006.01) |
| *E21B 44/00* | (2006.01) |
| *E21B 49/00* | (2006.01) |

(52) U.S. Cl.

CPC ..... *E21B 47/18* (2013.01); *E21B 47/14* (2013.01); *E21B 49/087* (2013.01); *E21B 44/00* (2013.01); *E21B 49/003* (2013.01); *E21B 49/08* (2013.01)

(58) Field of Classification Search

None

See application file for complete search history.

(56) References Cited

U.S. PATENT DOCUMENTS

| | | | | |
|---|---|---|---|---|
| 3,530,711 | A * | 9/1970 | Tocanne | E21B 47/102 166/264 |
| 4,003,252 | A * | 1/1977 | Dewath | G01F 1/66 73/861.27 |
| 4,532,812 | A * | 8/1985 | Birchak | E21B 21/08 73/152.21 |
| 5,662,165 | A * | 9/1997 | Tubel | E21B 23/03 166/113 |
| 6,532,828 | B1 * | 3/2003 | Delsing | G01F 1/662 73/861.01 |
| 6,874,361 | B1 * | 4/2005 | Meltz | E21B 43/14 73/152.32 |
| 2001/0023614 | A1 * | 9/2001 | Tubel | E21B 23/03 73/152.39 |
| 2002/0125008 | A1 * | 9/2002 | Wetzel | A45C 13/02 166/278 |

(Continued)

*Primary Examiner* — Jill E Culler

(74) *Attorney, Agent, or Firm* — Buche & Associates, P.C.; John K. Buche; Bryce A. Johnson

(57) ABSTRACT

Disclosed is a downhole tool comprising a fast hybrid telemetry module, and electronics module, and an acoustic flow meter tool module. Suitably, the fast hybrid telemetry module, the electronics module, and the acoustic flow meter tool module are assembled in series. Initially, the acoustic flow meter tool module is preferably provided for regular measurement of fluid temperature, fluid velocity, and fluid density in downhole oilfield production applications. Preferably, the electronics module is provided for data processing and self-compensation of the acoustic flow meter tool module (i.e., automated adjustment of acoustic wave energy and signal conditioning settings to perform flow rate measurements in a wide range of well bore conditions). Finally, the fast hybrid telemetry module is configured for bidirectional data transmission between the downhole tool and a surface data acquisition and monitoring station.

1 Claim, 14 Drawing Sheets

(56) References Cited

U.S. PATENT DOCUMENTS

| | | | | |
|---|---|---|---|---|
| 2005/0223808 | A1* | 10/2005 | Myers | G01N 29/024 73/629 |
| 2009/0049904 | A1* | 2/2009 | Meister | E21B 49/10 73/152.23 |
| 2009/0166037 | A1* | 7/2009 | Sroka | E21B 49/082 166/264 |
| 2014/0102695 | A1* | 4/2014 | Adil | E21B 47/065 166/250.01 |
| 2014/0136126 | A1* | 5/2014 | Ao | G01N 9/00 702/48 |
| 2018/0045045 | A1* | 2/2018 | Castillo | E21B 47/06 |

* cited by examiner

ACOUSTIC FLOW METER TOOL AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of downhole flow meter tools.

Background of the Invention

In the oil and gas industry, natural resources are extracted from the earth's subsurface via boreholes or wells (hereinafter "wellbores") dug-out by a drilling rig. Typically, wellbores are drilled into the subsurface by the drilling rig via operation of a drill bit at the end of a column or string of pipe that transmits drilling fluid and torque to the drill bit. Once drilled, other tools can also be run into the wellbore on a column of drill pipe or tubing ("tool string"). Usually, it is necessary to collect data from both inside the wellbore and inside of the tool string (collectively "downhole data") for a variety of purposes, including production logging operations (i.e., generating operations statistics and performance benchmarks).

Some of the downhole data obtained from production logging operations includes fluid parameters that are indicative of well performance. This downhole data can be used to predict future problems with the well and, accordingly, take preventative action so that well production is not negatively affected or interrupted. One of the most important fluid parameters is downhole fluid velocity because that parameter is readily converted to well production (barrel (bbl) per day).

In view of the foregoing, downhole tools are known to incorporate flow meter devices for measuring fluid velocity. Known flow meter devices typically involve measurement of fluid velocity by moving the downhole fluid over mechanical rotating mechanisms of the flow meter devices.

Furthermore, mechanical flow meter tools are usually designed for specific working conditions. These condition specific limitations are problematic because unexpected changes in working conditions can necessitate the swapping out of several flow meter tools during a single project. Other types of flow meter tools can work under varying conditions at the cost of lost accuracy of measurement. Thus, a need exists for a downhole flowmeter tool that covers a wide range of working conditions without a compromise in measurement accuracy.

DESCRIPTION OF RELATED ART

WO2008053193A1 by Imi Vision Ltd. (circa 2008) discloses an "ultrasonic flow-rate measurement device."

U.S. Pat. No. 7,503,225 by Robert Bosch GmbH (circa 2009) discloses an "ultrasonic flow sensor having a transducer array and reflective surface."

DE102014106429A1 by Sick A G (circa 2006) discloses a flow measurement device and method for measuring the flow velocity of a fluid.

WO2015160235A1 & US2017038234A1 by Berkin B. V. (circa 2017) discloses an "ultrasonic flow meter."

U.S. Pat. No. 6,532,828 by D-Flow Group AB (circa 2003) discloses a device for temperature compensation in an acoustic flow meter.

JPS56115919 by Toshiba (circa 1980) discloses an ultrasonic current meter for high temperature."

U.S. Pat. No. 6,202,494 by Riebel et al. (circa 2001) discloses a "process and apparatus for measuring density and mass flow.

U.S. Pat. No. 4,532,812 by Birchak (circa 1985) disclose a "parameteric acoustic flow meter."

U.S. Pat. No. 4,003,252 by Dewath (circa 1977) discloses an "acoustical wave flowmeter."

EP1733222B1 & US20050223808A1 by Shell Int'l, B.V. (circa 2005) discloses an "apparatus and methods for acoustically determining fluid properties while sampling."

FR2369566A1 & U.S. Pat. No. 4,144,752 by Danfoss (circa 1982) discloses an "ultrasonically operative device for determining physical quantities of a medium."

U.S. Pat. No. 4,598,593 by Sheen et al. (circa 1986) discloses an "acoustic cross-correlation flowmeter for solid-gas flow."

SUMMARY OF THE INVENTION

In view of the foregoing it is an objective to disclose a downhole tool for measuring production logging parameters, like fluid velocity, which do not have the limitations of known downhole tools. For instance, it is an objective to disclose a downhole tool that measures fluid velocity via acoustics instead of via mechanical means so that the tool does not have threshold limitations on velocity measurements and can instead provide data acquisition and processing over a wide range of fluid velocities. Similarly, it is an objective to disclose a single tool with application to measure a wide range of wellbore conditions so that the single tool can replace multiple tools that each only apply to specific wellbore conditions. Additionally, an objective of this document is to describe a downhole tool that is easily maintained and that has high durability. Finally, it is an objective of this disclosure to detail a downhole tool that reduces inaccuracies of measurements due to friction between moving parts.

Disclosed is a downhole tool comprising a fast hybrid telemetry module, an electronics module, and an acoustic flow meter tool module. Suitably, the fast hybrid telemetry module, the electronics module, and the acoustic flow meter tool module are assembled in series. Initially, the acoustic flow meter tool module is preferably provided for regular measurement of fluid temperature, fluid velocity, and fluid density in downhole oilfield production applications. Preferably, the electronics module is provided for data processing and self-compensation of the acoustic flow meter tool module (i.e., automated adjustment of acoustic wave energy and signal conditioning settings to perform flow rate measurements in a wide range of well bore conditions). Finally, the fast hybrid telemetry module is configured for bidirectional data transmission between the downhole tool and a surface data acquisition and monitoring station.

A preferred embodiment of the downhole tool is generally tubular and configured for downhole placement in a wellbore. Specifically: the fast hybrid telemetry module may be defined by a substantially fluid tight tubular casing with internal telemetry and data communication or storage components; the electronic module may be defined by a substantially fluid tight tubular casing with an internal printed circuit board (PCB); and the acoustic flow meter tool module may be defined by an open ended tubular casing that can accept flowing fluid through the open end as a fluid inlet and discharge the accepted fluid through outlet apertures on the otherwise closed end of the tubular casing, wherein the acoustic flow meter tool module internally features two ultrasonic transducers for measuring the velocity of accepted fluid, one ultrasonic transducer for measuring the density of the accepted fluid, and one temperature sensor for measuring the temperature of the accepted fluid as the fluid moves between the inlet and outlet apertures of the open ended tubular casing.

Suitably, the three modules (i.e., the acoustic flow meter tool module, the electronics module, and the fast hybrid telemetry module are mechanically coupled in series via substantially fluid tight and tubular connections to form an extended tubular apparatus. Internally, the acoustic flow meter tool is electrically coupled to the electronics module communicably coupled to the fast hybrid telemetry module via an internal bus and/or a bidirectional data bus. Finally, a wireline with bidirectional data transmission may electrically and communicably couple the fast hybrid telemetry module with an above ground surface data acquisition, control, and monitoring station.

In a preferred embodiment, the general specifications of the disclosed downhole tool are:

Max Pressure 15000 psi;
Max Temperature 177° C. (350° F.);
Tool Diameter 1 & 11/16 inch;
Tool Length 14-76 inch (adjustable); and,
Connectivity GO end connectors.

In operation, the disclosed acoustic flow meter tool module measures: fluid temperature via a temperatures sensor; fluid velocity via measurements of (a) an acoustic wave traveling with the flow of the fluid and (b) an acoustic wave traveling against the flow of the fluid; and fluid density via measurement of an acoustic wave traveling across the flow of the fluid. Suitably, the measurements are then processed in the electronics module. In practice, such measurements and processing enable accurate and resolute data acquisition over a wide range of fluid velocities. Specifically, data processing and self-compensating algorithms are implemented via the PCB to guarantee data quality. Finally, data is communicated to the fast hybrid telemetry module and either stored for extraction at a later date or transmitted to the above ground surface data acquisition, control, and monitoring station. In a preferred embodiment, the fast hybrid telemetry unit includes both (a) memory module capable of storage of 32 Gbyte or continuous 60-day recording or (b) wiring for data uplinks at 400 kbps for a real-time surface data monitor.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Figure 1:
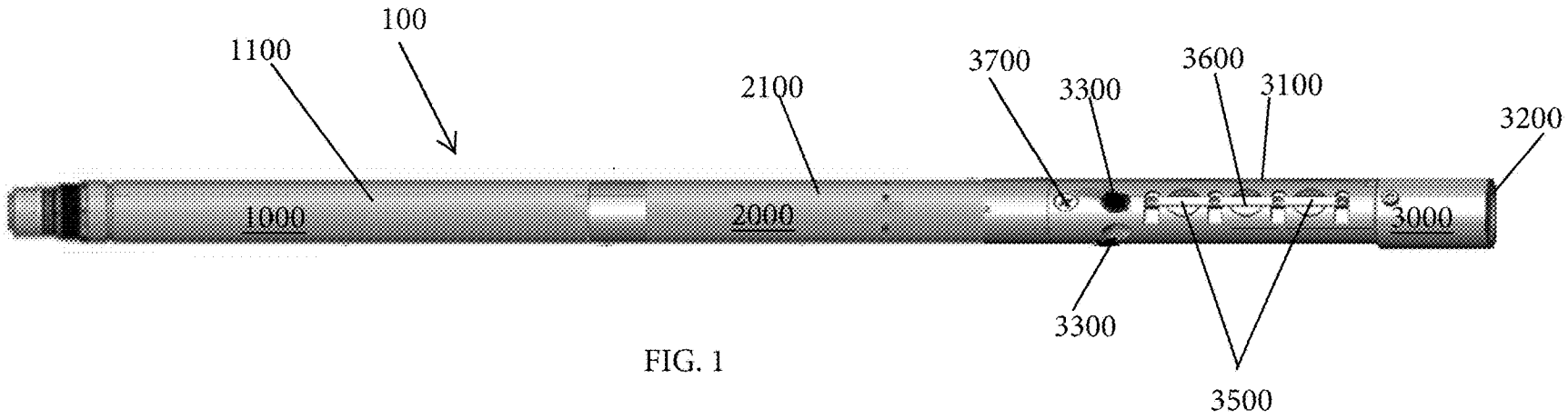
FIG. 1 is a front view of an assembly of a fast hybrid telemetry module, electronics module, and acoustic flow meter tool module.

In the figures, the following components are represented by the associated reference numerals:

downhole tool—100;
tubular connection—110;
fast hybrid telemetry tool module—1000;
tubular casing—1100;
main process module 1200;
memory data storage 1300;
electronics module—2000;
tubular casing 2100;
acoustic flow meter tool module—3000;
open ended tubular casing—3100;

open end—3200;

outlet apertures—3300;

closed end—3400;

ultrasonic transducers—3500 (for measuring the velocity of accepted fluid);

ultrasonic transducer—3600 (for measuring the density of the accepted fluid);

temperature sensor—3700 (for measuring the temperature of the accepted fluid);

surface data acquisition and monitoring station—4000;

wireline—5000;

Gamma Ray/Temperature/CCL module 6000;

n Logging tool module 7000;

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFFERED EMBODIMENTS

FIG. 1 is a generic front view of a downhole tool 100 defined by an assembly of a fast hybrid telemetry module 1000, electronics module 2000, and acoustic flow meter tool module 3000. As shown, the fast hybrid telemetry module 1000, the electronics module 2000, and the acoustic flow meter tool module 3000 are assembled in series, where the acoustic flow meter tool module 3000 defines the upstream (relative to fluid moving through a wellbore) end of the downhole tool. Although the electronics module 2000 and the acoustic flow meter tool module 3000 are shown as two separate modules, it should be appreciated that the acoustic flow meter tool module 3000 and the electronics module 2000 can be combined or constructed as a single unit or single acoustic flow meter tool.

As discussed in greater detail below, the acoustic flow meter tool module 3000 is preferably provided for regular measurement of fluid temperature, fluid velocity, and fluid density in downhole oilfield production applications. Also discussed further below, the electronics module 2000 is provided for data processing and self-compensation of the acoustic flowmeter tool module 3000. Finally and also discussed in more detail below, the fast hybrid telemetry module 1000 is configured for bidirectional data transmission between the downhole tool and a surface data acquisition and monitoring station 4000.

Still referring to FIG. 1, the depicted downhole tool 100 is generally tubular and configured for downhole placement in a wellbore with the acoustic flow meter tool module deposited in the wellbore first. FIG. 1 generically depicts the structural connectivity of downhole tool 100. As shown, the the fast hybrid telemetry module 1000 may be defined by a substantially fluid tight tubular casing 1100 with internal telemetry and data communication or storage components (not shown); the electronic module 2000 may be defined by a substantially fluid tight tubular casing 2100 with an internal printed circuit board (PCB) (not shown); and the acoustic flow meter tool module 3000 may be defined by an open ended tubular casing 3100 that can accept flowing fluid (not shown) through the open end 3200 as a fluid inlet and discharge the accepted fluid (not shown) through outlet apertures 3300 on the otherwise closed end 3400 of the tubular casing 3100, wherein the acoustic flow meter tool module 3100 internally features two ultrasonic transducers 3500 for measuring the velocity of accepted fluid (not shown), one ultrasonic transducer 3600 for measuring the density of the accepted fluid (not shown), and one temperature sensor 3700 for measuring the temperature of the accepted fluid (not shown) as the fluid (not shown) moves between the inlet end 3200 and outlet apertures 3300 of the open ended tubular casing 3100. Suitably, the downhole tool 100 (i.e., the acoustic flow meter tool module 3000, the electronics module 2000, and the fast hybrid telemetry module 1000 are mechanically coupled in series via substantially fluid tight and tubular connections 110 to form an extended tubular apparatus.

Figure 2:
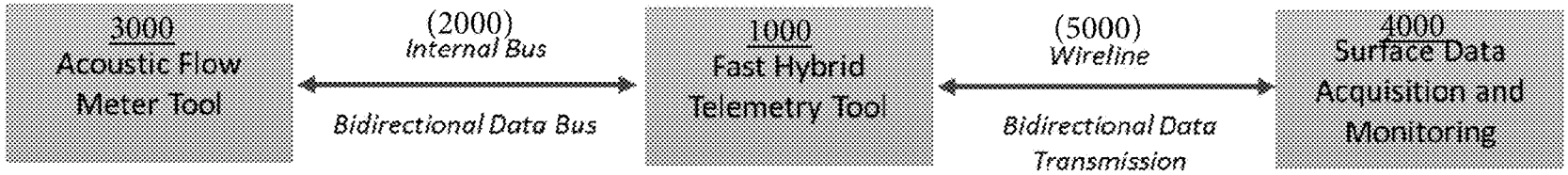
FIG. 2 is a schematic of the data transmission of the fast hybrid telemetry module and acoustic flow meter tool module.

FIG. 2 is a schematic of the data transmission to the surface data acquisition and monitoring station 4000 by the fast hybrid telemetry module 1000 and acoustic flow meter tool module 3000. Internally, the acoustic flow meter tool 3000 is electrically coupled to the electronics module 2000 communicably coupled to the fast hybrid telemetry module 1000 via an internal bus and/or a bidirectional data bus in the electronics module 2000. Finally, a wireline 5000 with bidirectional data transmission may electrically and communicably couple the fast hybrid telemetry module 1000 with an above ground surface data acquisition, control, and monitoring station 4000.

Still referring to FIG. 2, the acoustic flow module 3000 collects sensors data and transmits the information in a specific protocol. Suitably, communication between the acoustic flow meter tool module 3000 and fast hybrid telemetry module 1000 is bidirectional so that both downhole data and receiving commands can be communicated. Alternatively or additionally, a bidirectional communication may be established between fast hybrid telemetry tool 1000 and surface monitoring station 4000. In practice, data sent from the acoustic flow meter tool 300 and any other of the fast hybrid telemetry module 1000 may be sent to the surface station 4000 using an optimized protocol through the wireline 5000. As can be appreciated, commands generated by an operator in surface station 4000 may be received through the wireline 5000 and decoded by the electronics module 2000 for later redirection to the components of downhole tool 100.

Yet still referring to FIG. 2, which shows real time data transmission from the down hole tool 100 to a surface station 4000, the fast hybrid telemetry module includes memory data storage. In one mode of operation, memory data can be download at surface station 4000 once operations are complete (aka surface read out). With further regard to the surface data acquisition and monitoring station 4000, a computing system (not shown) may be configured for real time acquisition of downhole data, graphing of data results, and monitoring and processing of information based on downhole conditions. In a preferred embodiment, the general specifications of the disclosed downhole tool 100 are:

Max Pressure 15000 psi;

Max Temperature 177° C. (350° F.);

Tool Diameter 1 & 11/16 inch;

Tool Length 14-76 inch (adjustable); and,

Connectivity GO end connectors.

General Operation of the Downhole Tool 100

In operation, the disclosed acoustic flow meter tool module 3000 measures: fluid temperature via a temperatures sensor; fluid velocity via measurements of (a) an acoustic wave traveling with the flow of the fluid and (b) an acoustic wave traveling against the flow of the fluid; and fluid density via measurement of an acoustic wave traveling across the flow of the fluid. Suitably, the measurements are then processed in the electronics module via programming on the PCB. In practice, such measurements and processing enable accurate and resolute data acquisition over a wide range of fluid velocities. Specifically, data processing and self-compensating (i.e., automated adjustment of acoustic wave energy and signal conditioning settings to perform flow rate measurements in a wide range of well bore conditions) algorithms are implemented via the PCB to guarantee data quality. Finally, data is communicated to the fast hybrid telemetry module and either stored for extraction at a later date or transmitted to the above ground surface data acquisition, control, and monitoring station. In a preferred embodiment, the fast hybrid telemetry unit includes both (a) computer storage capable of 32 Gbyte or continuous 60-day recording or (b) wiring for data uplinks at 400 kbps for a real-time surface data monitor.

Fast Hybrid Telemetry Tool 1000

Figure 3:
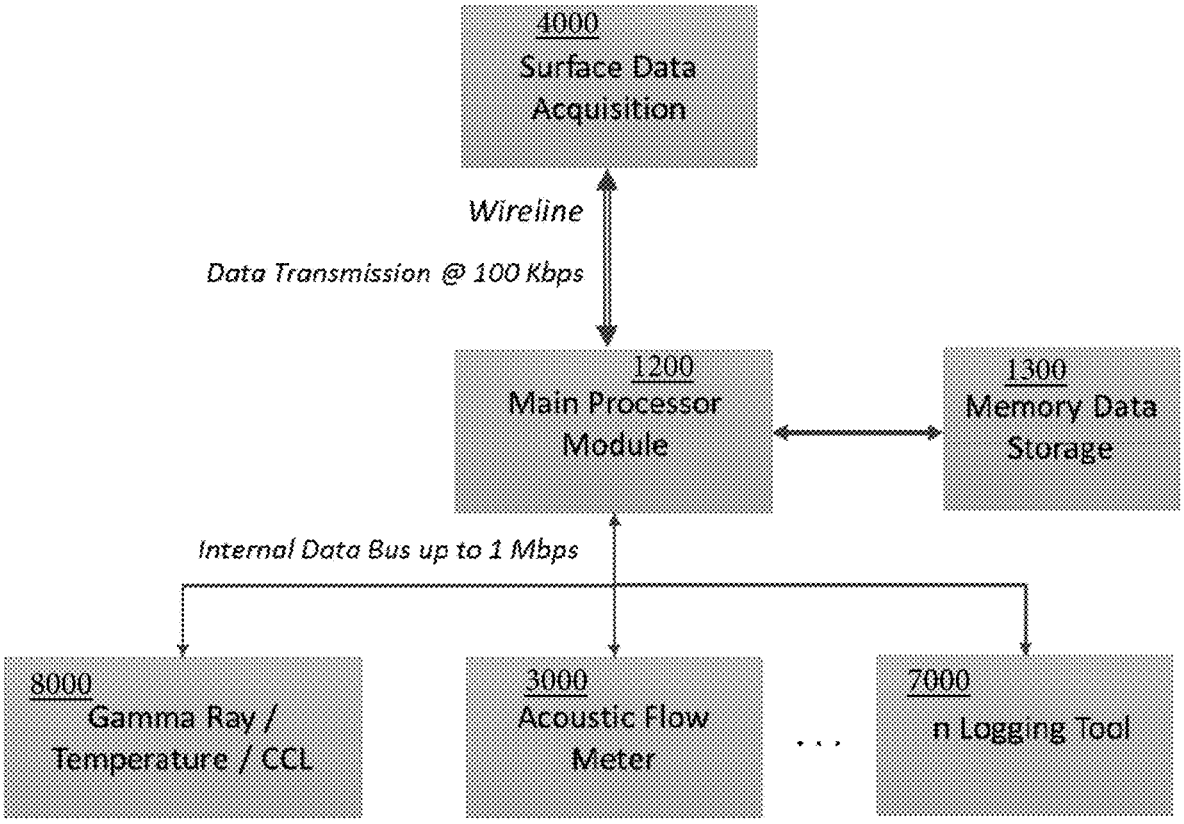
FIG. 3 is a general block diagram of the fast hybrid telemetry module.
Figure 4:
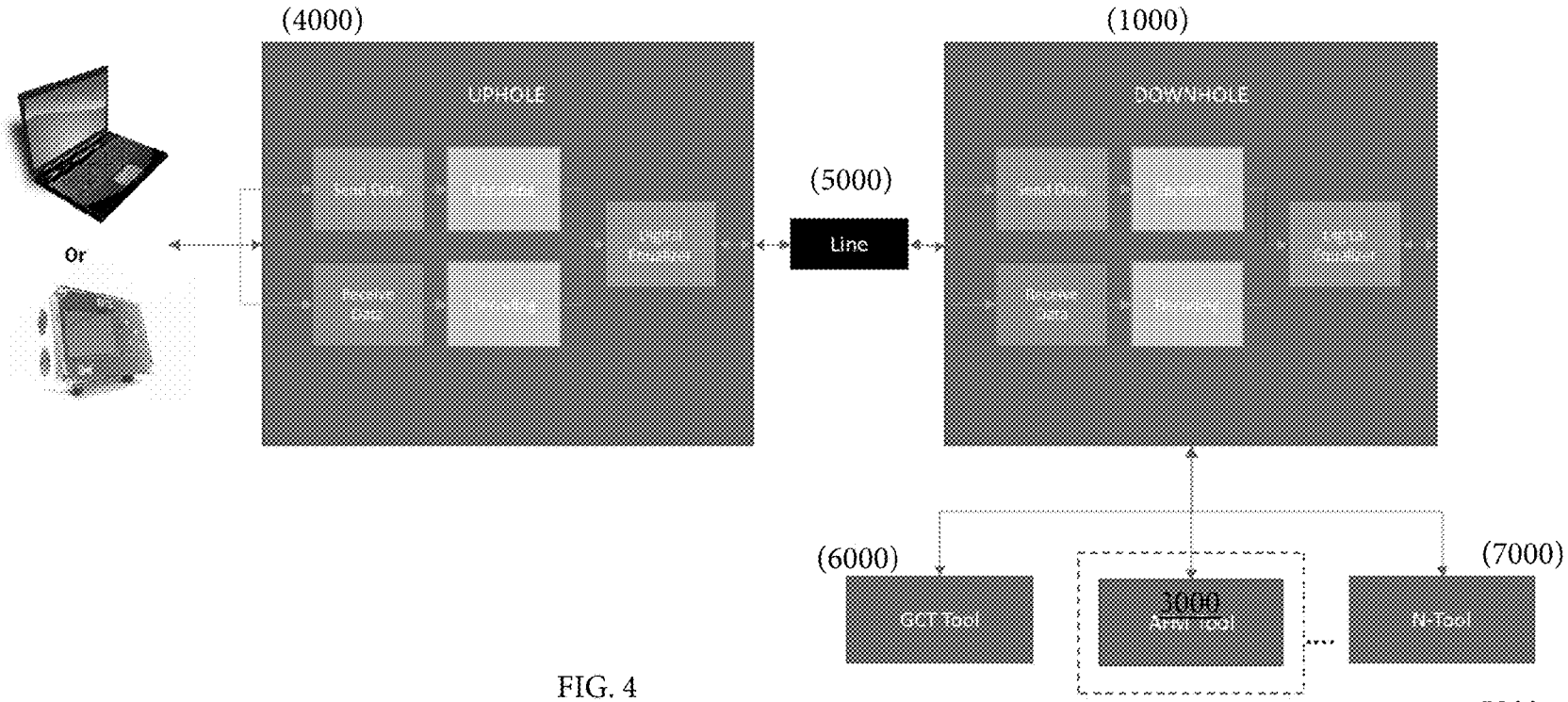
FIG. 4 is a firmware flow diagram for the fast hybrid telemetry module.
Figure 5:
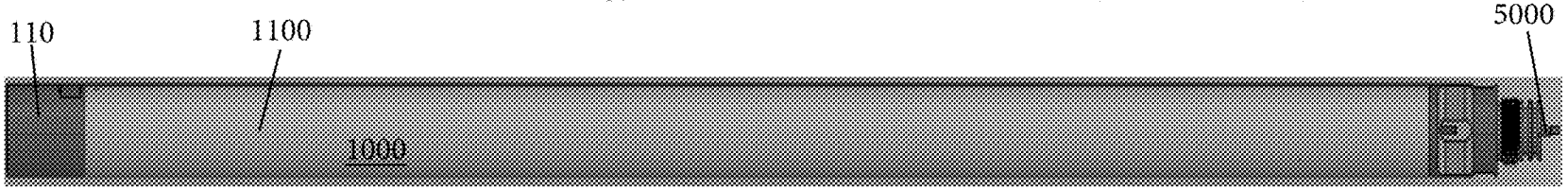
FIG. 5 is a front view of the fast hybrid telemetry module.
Figure 6:
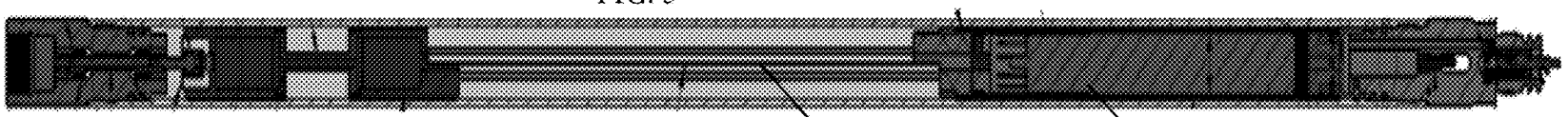
FIG. 6 is a cross section of the fast hybrid telemetry module.

As previously discussed, the fast hybrid telemetry module 1000 enables downhole to surface 4000 bidirectional communication. FIG. 3 is a general block diagram of the fast hybrid telemetry module 1000. FIG. 4 is a firmware flow diagram for the fast hybrid telemetry module. As shown in these figures, the fast hybrid telemetry module 1000 comprises a main process module 1200 and memory data storage 1300 (See also FIG. 5, which is a front view of the fast hybrid telemetry module 1000 and FIG. 6 is a cross section of the fast hybrid telemetry module 1000). Suitably, the main processor module 1200 can connect to the acoustic flow meter module 300 and any downhole module (e.g., a Gamma Ray/Temperature/CCL module 6000 or n Logging tool module 7000) that one of skill in the art may see fit to include in the disclosed downhole tool 100. Suitably, the main processor may connect to the acoustic flow meter tool module 3000 via a high-speed serial protocol (One Wire Bus) with an internal bus speed up to 1 Mbps. Data collected from acoustic flow meter tool module 3000 or any other tool (6000, 7000) may be sent to a surface station 4000 in real time and at the same time, a backup of data in the memory data storage can be performed, where the memory data storage is configured to store data continuously for 60 days.

In a preferred embodiment, general specifications are:

Operating Voltage: +48 VDC

Sensors: Casing Collar Locator CCL, Gamma Ray, Temperature.

Diameter: 1-11/16 inch

Length: 46 inch.

Operating Pressure: 15000 psi

Operating Temperature: 350° F.

Surface Data transmission: Up to 400 Kbps.

Memory capacity: 32 Gbyte.

Acoustic Flow Meter Tool Module 3000 & Electronics Module 2000

Figure 7:
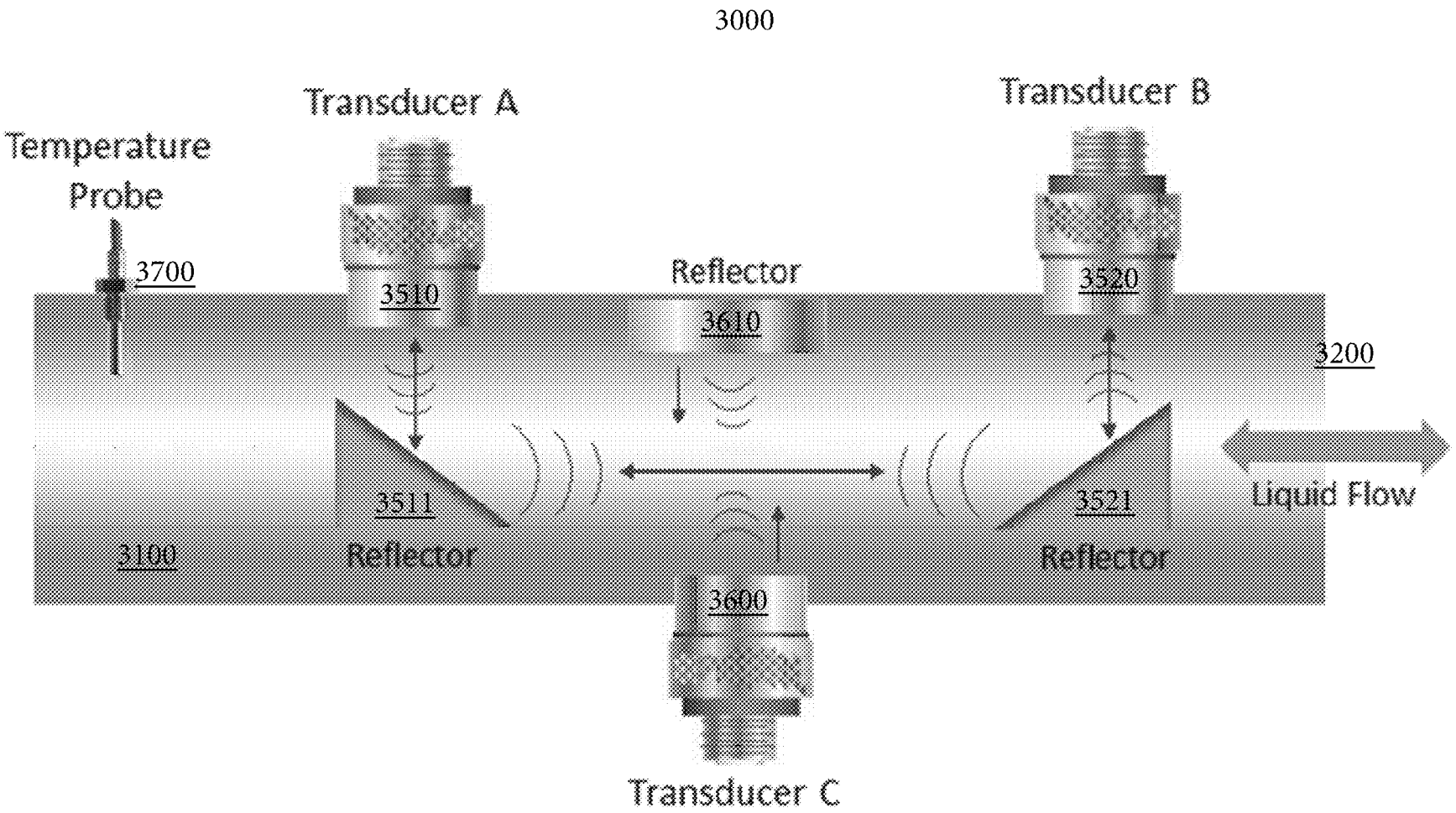
FIG. 7 is schematic of the general working principles of the acoustic flow meter tool module.

FIG. 7 is schematic of the general working principles of the acoustic flow meter tool module 3000. As shown, the acoustic flow meter tool module 3000 may be defined by an open ended tubular casing 3100 that can accept flowing fluid (arrows) through the open end 3200 as a fluid inlet and discharge the accepted fluid through outlet apertures (3300, not shown) on the otherwise closed end (3400, not shown) of the tubular casing 3100. As is further shown, the acoustic flow meter tool module 3000 internally features two ultrasonic transducers 3510 and 3520 for measuring the velocity of accepted fluid (arrows), one ultrasonic transducer 3600 for measuring the density of the accepted fluid (arrows), and one temperature sensor 3700 for measuring the temperature of the accepted fluid (arrows) as the fluid moves between the inlet 3200 and outlet apertures (not shown) of the open ended tubular casing 3100.

In operation, the disclosed acoustic flow meter tool 3000 module measures: fluid temperature via the temperatures sensor 3700; fluid velocity via measurements of (a) an acoustic wave traveling with the flow of the fluid and (b) an acoustic wave traveling against the flow of the fluid; and fluid density via measurement of an acoustic wave traveling across the flow of the fluid. In other words, the velocity and density measurements are based on the physical principles involved in a mechanical wave traveling through a fluid media, wherein the characteristics of the mechanical wave (transit time, attenuation, etc.) depend on the fluid medium's properties (density, viscosity, temperature) and whether or not the fluid medium is stationary flowing.

Still referring to FIG. 7, two ultrasonic transducers (3510 and 3520) are located at a fixed (but adjustable) distance from the one another. In a preferred embodiment, high temperature tolerant piezoelectric transducers are used working at 1 MHz, which is an appropriate frequency for an acoustic wave traveling in water or mixtures of water and oil. Suitably, two reflectors (3511 and 3521) are located in the path of the ultrasonic signals of the transducers (3510 and 3520) to reflect and conduct the wave from one transducer to the other transducer. With a configurable periodicity (typically 25-100 mS), one transducer 3510 is excited with a train of pulses, wherein the acoustic signal is received by the other transducer 3520 and wherein the transit time of the wave for this first trajectory or pass is recorded. Next, the other transducer 3520 is excited to send a wave in the reverse direction to the first transducer 3510 and transit time for the reverse route is also measured. Both travel times are computed to determine the fluid's (arrow) velocity and direction. As discussed below in connection with the electronics module 2000 (not shown), high precision electronics may be incorporated to measure travel times, so fractions of time in the order of nanoseconds can be measured, which represents a high resolution in the calculation of fluid velocity and flow.

Yet still referring to FIG. 7, a third transducer 3600 may be employed as a continuous reference sensor. To this end, a reflective body 3610 is installed at a fixed and known distance from the transducer 3600. In this configuration, the transducer 3600 may be excited to produce a wave that is echoed by the reflector 3610 and returned to the transducer 3600. Recording the wave transit time allows determination of the velocity of the acoustic wave in the presence of the fluid (arrows). This value is particularly important because it can be used to identify the fluid by density and viscosity. Additionally, this measurement can account for changes in fluid compositions since this reference value permits an accurate calculation of fluid velocity, even if fluid type or flow characteristics (velocity, temperature, density, etc) are changing. So, the acoustic flow meter tool calculates the velocity of the fluid even if the fluid compositions are not constant during the measuring processing since the identity of fluid is being determined via the third transducer 3600.

Yet further still referring to FIG. 7, the acoustic flow meter tool 3000 includes a high sensitivity temperature sensor 3700. In one mode of operation, the temperature readings are stored and used for tool self-compensation.

Suitably, the measurements from the transducers 3510, 3520, 3600 and temperature sensor 3700 are then processed in the electronics module 2000 via programming on the PCB. In one embodiment the PCB is defined by high temperature electronic circuits that measure the behavior of an ultrasonic wave traveling in a fluid in movement to determine the fluid's velocity. In practice, such measurements and processing enable accurate and resolute data acquisition over a wide range of fluid velocities. Specifically, data processing and self-compensating algorithms are implemented via the PCB to guarantee data quality.

Figure 8:
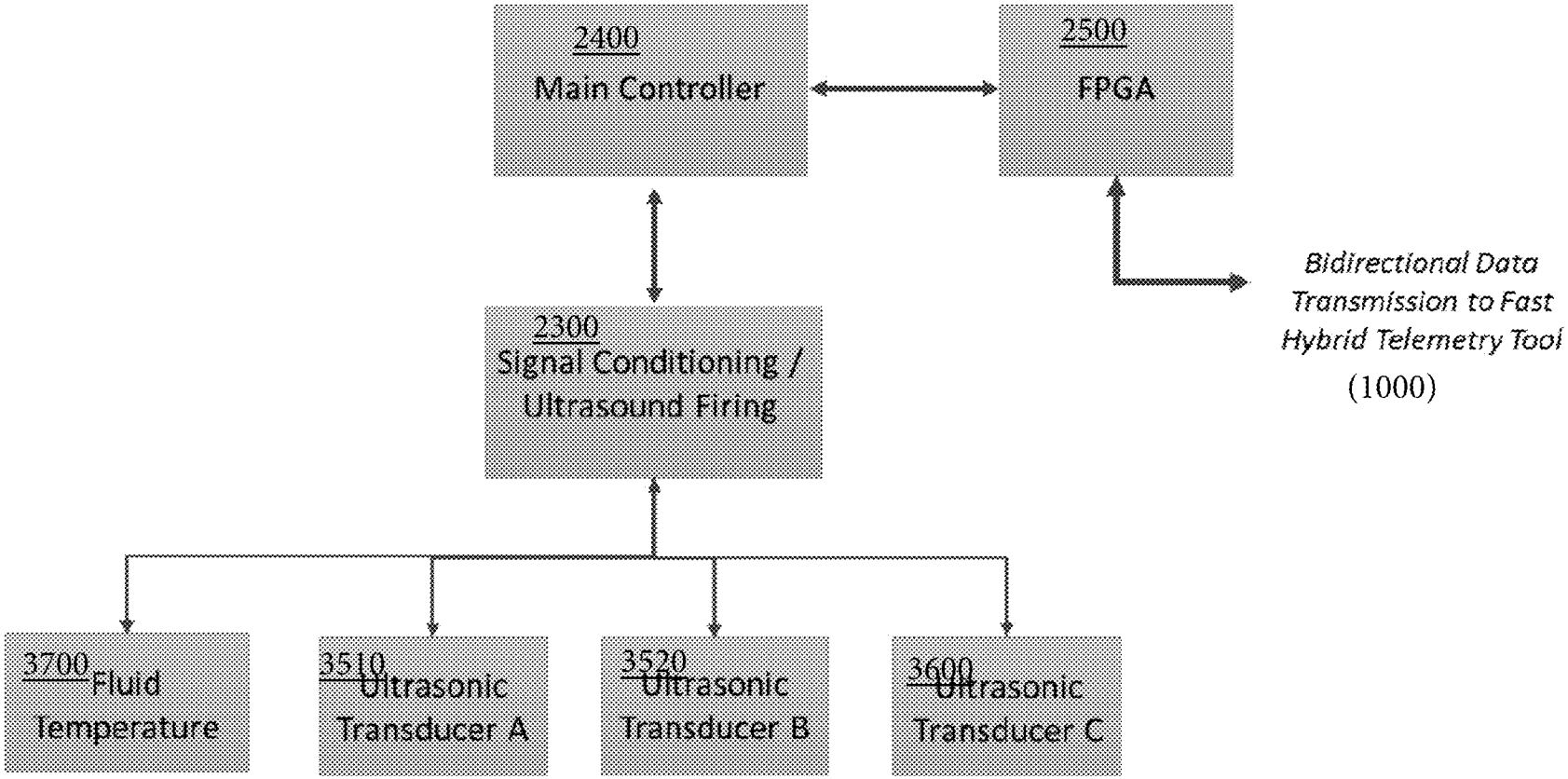
FIG. 8 is an internal block diagram of the acoustic flow meter tool module.

FIG. 8 is an internal block diagram of the electronics module 2000. As shown in FIG. 8, the electronics module 2000 handles four analog sensor signals, one from each of the transducers 3510, 3520, and 3600 and the temperature sensor 3700. Those signals are all sent to a signal conditioning/ultrasound firing module 2200. As mentioned, 1 MHz, piezoelectric transducers 3510, 3520, 3600 are preferably used. In order to excite ultrasonic transducers the electronics generates a train of pulses. It is important to notice that the amplitude of the firing pulses, which directly involves the acoustic wave energy, is automatically adjusted by a self-tuning algorithm. It implies that AFMT can work in a wide range of fluid conditions, including fluid velocity, density and temperature, since the quality of transmitted/received acoustic signal is controlled and verified at every firing cycle. Also included in the electronics module is a main controller 2300 and an FPGA 2400. Ultimately, the data will be sent to the fast hybrid telemetry unit 1000.

As stated above, firing frequency of the transducers 3510, 3520, 3600 can be adjusted. Typically, intervals of 25-100 mS are preferred. As previously discussed, a firing/acquisition sequence is performed every time for both velocity measuring transducers 3510, 3520. Similarly, the density determining transducer 3600 may be excited to identify fluid type, with a programmable periodicity. Piezoelectric ultrasonic transducers 3510, 3520, 3600 can be excited with pulses of several volts or even hundreds of volts depending on the fluid material, construction or application, but the amplitude of the signal generated when they are excited by the pressure wave (receiving mode) is only in the order of few millivolts. So, special care should be taken in acquisition circuitry to obtain good quality ultrasonic signal and to reject noise that in some cases could be in the range of the desired signal. With this purpose, a high sensitivity Analog Front End (analogical and digital signal conditioning module) has been included in the electronics module 2000.

Figure 9:
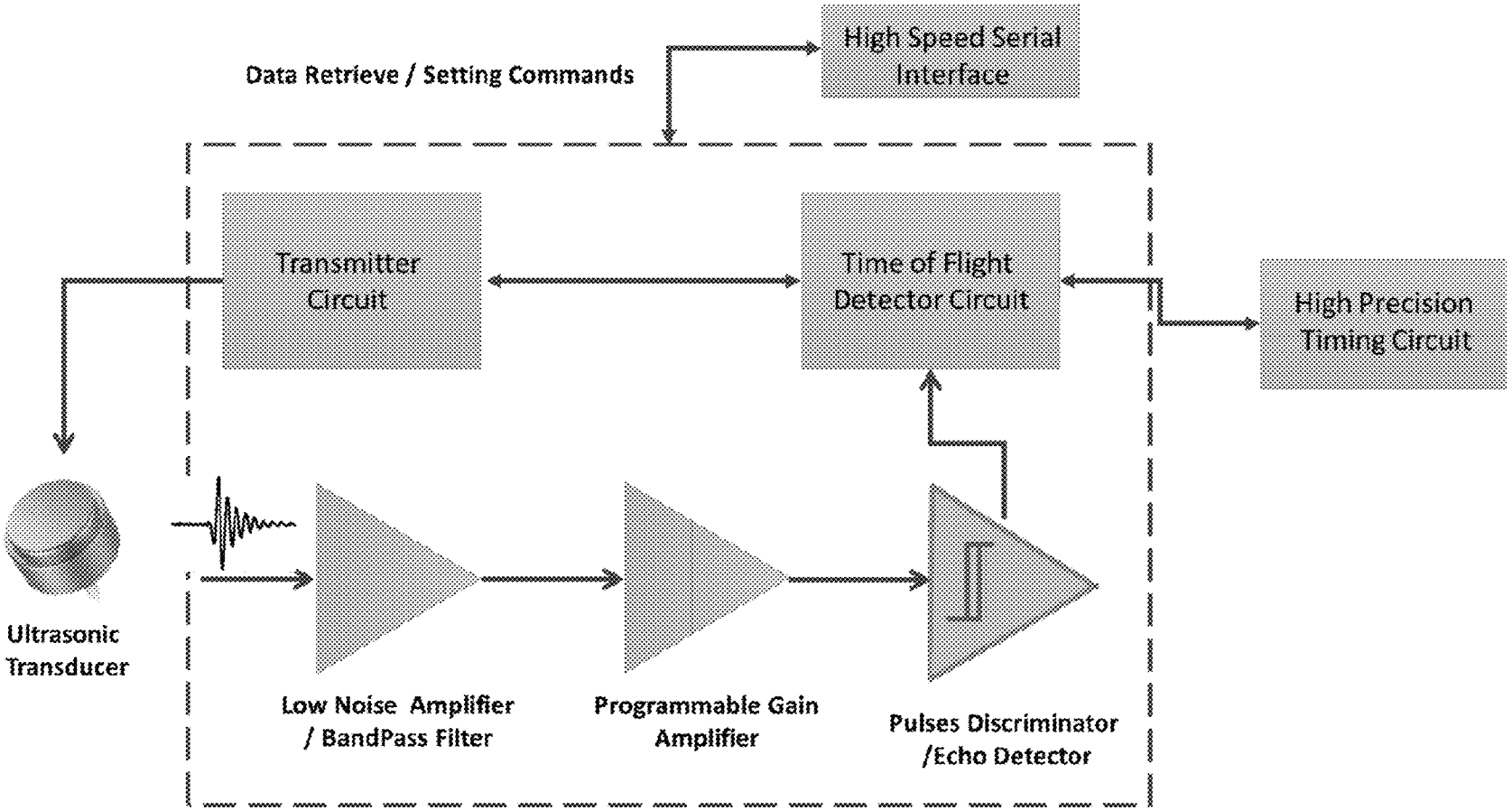
FIG. 9 is a general block diagram of the analogical and digital signal conditioning.

FIG. 9 is a general block diagram of the analogical and digital signal conditioning module 2300 of FIG. 8. In general terms, the analogical and digital signal conditioning module consists of a low noise amplification stage, adjustable band pass filter, a programmable gain amplifier stage (user adjustable via downhole command or self-adjusted, according to tool settings), and pulse discriminators to determine when a valid echo pulse is detected. Working together with the analogical and digital signal conditioning module is a high precision timing circuit that starts and stops a high-resolution digital counter that determines time of travel of ultrasonic waves and fluid velocity. These high-performance electronics (analog and digital) make AFMT a flow meter device suitable for a wide range of fluid velocities (0.01 m/s to 50 m/s, approx.). A high-speed serial interface communication is implemented to allow the analogical and digital signal conditioning module and Timing Circuit to receive real time commands and to send ultrasonic data.

Figure 10:
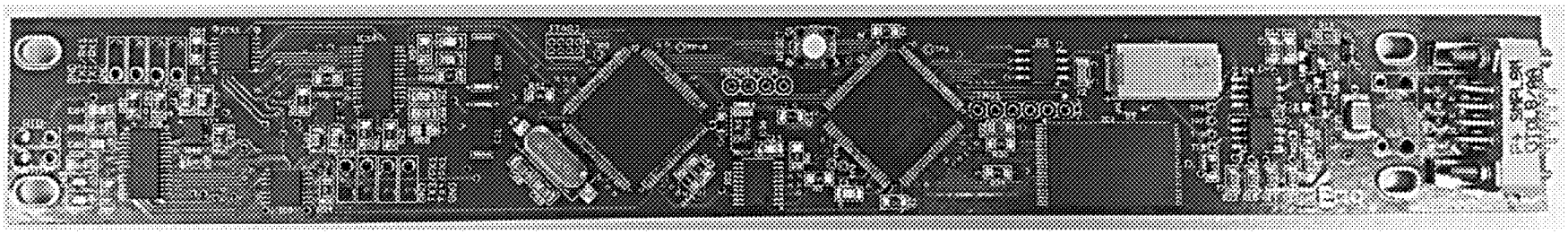
FIG. 10 is a top view of the printed circuit board of the acoustic flow meter tool module.
Figure 11:
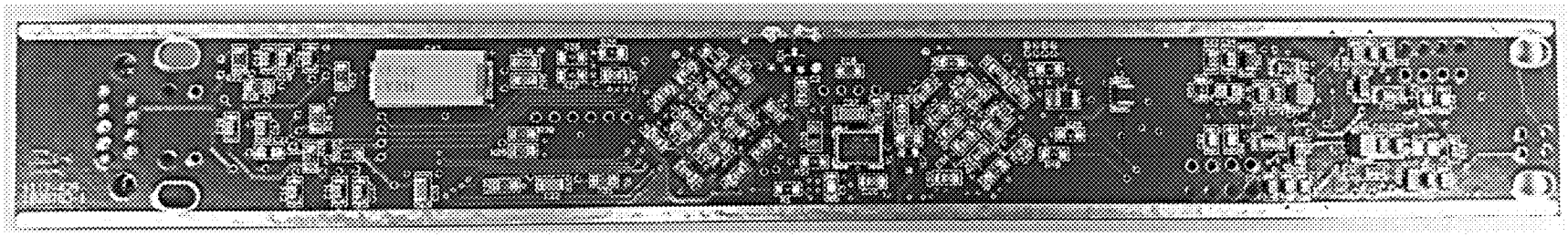
FIG. 11 is a bottom view of the printed circuit board of the acoustic flow meter tool module.

FIGS. 10 and 11 show a PCB of the electronics module 2000 that includes analogical and digital signal conditioning module, Main Controller, Memory and Data Communication with FHT. FIG. 10 is a top view of the printed circuit board of the acoustic flow meter tool module.

Figure 12:
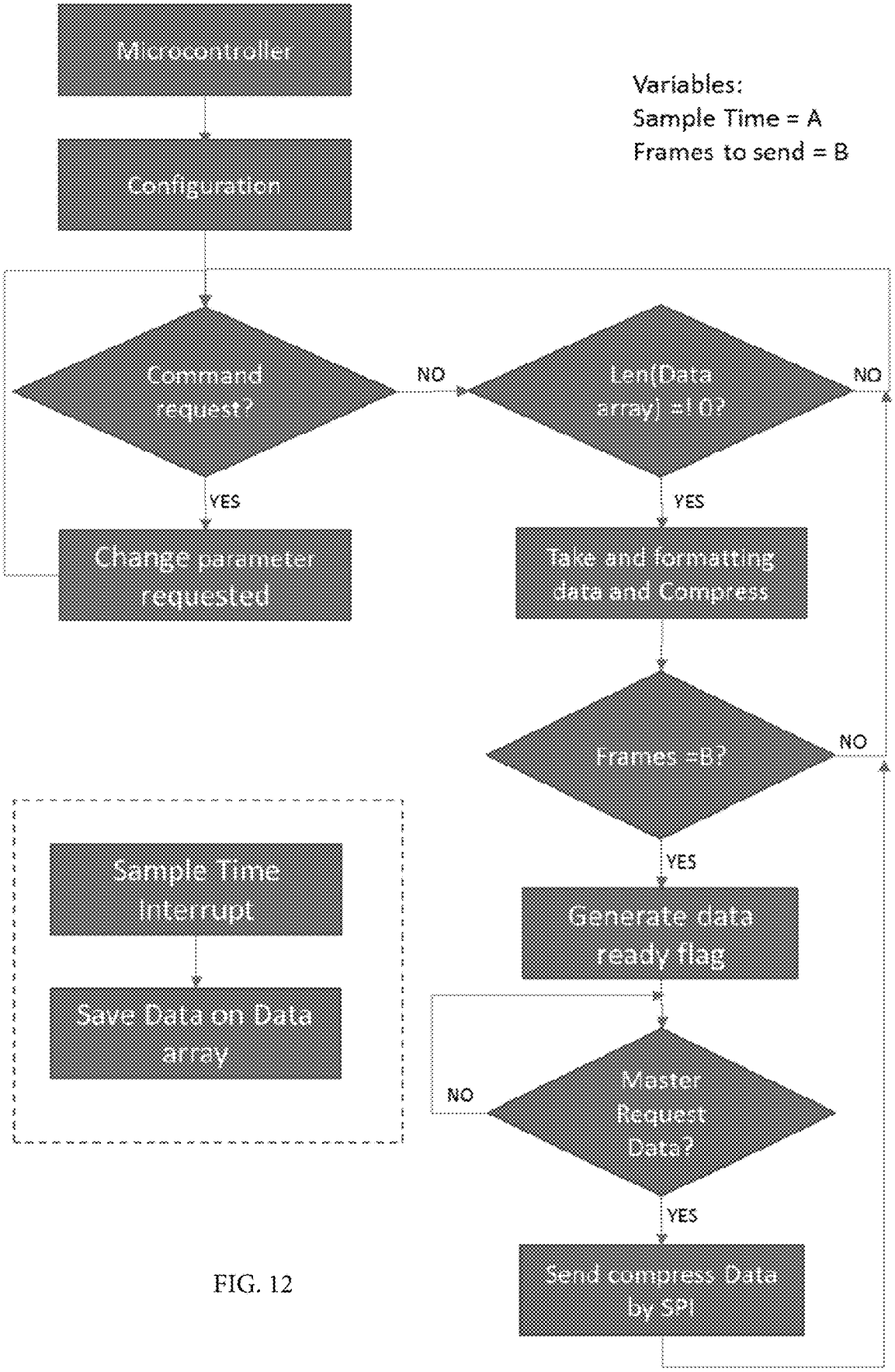
FIG. 12 is a general flow diagram of the main microcontroller firmware for the acoustic flow meter tool module.
Figure 13A:
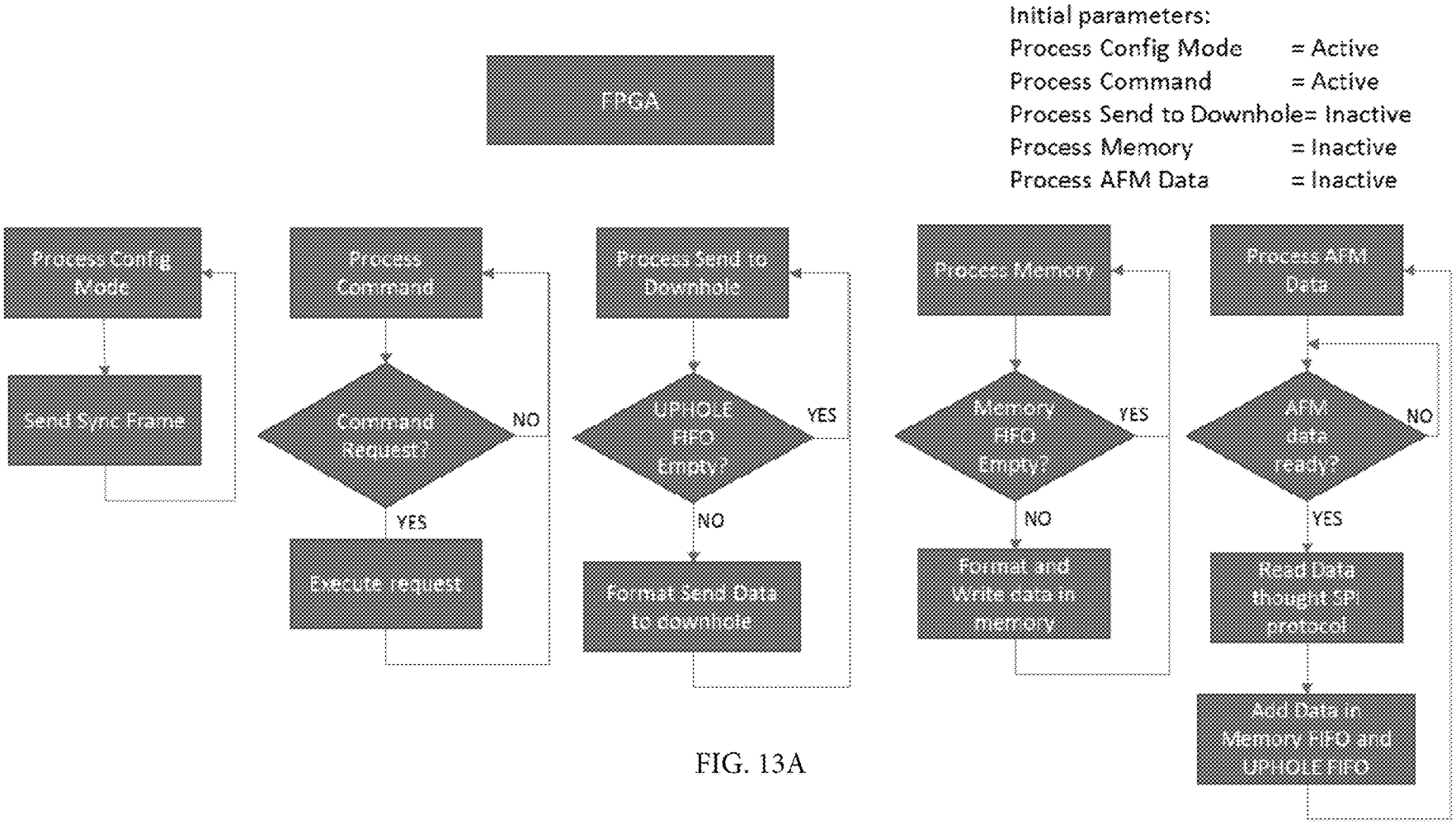
FIG. 13A is a first part of a general flow diagram of the field-programmable gate array (FPGA) of the acoustic flow meter tool module.
Figure 13B:
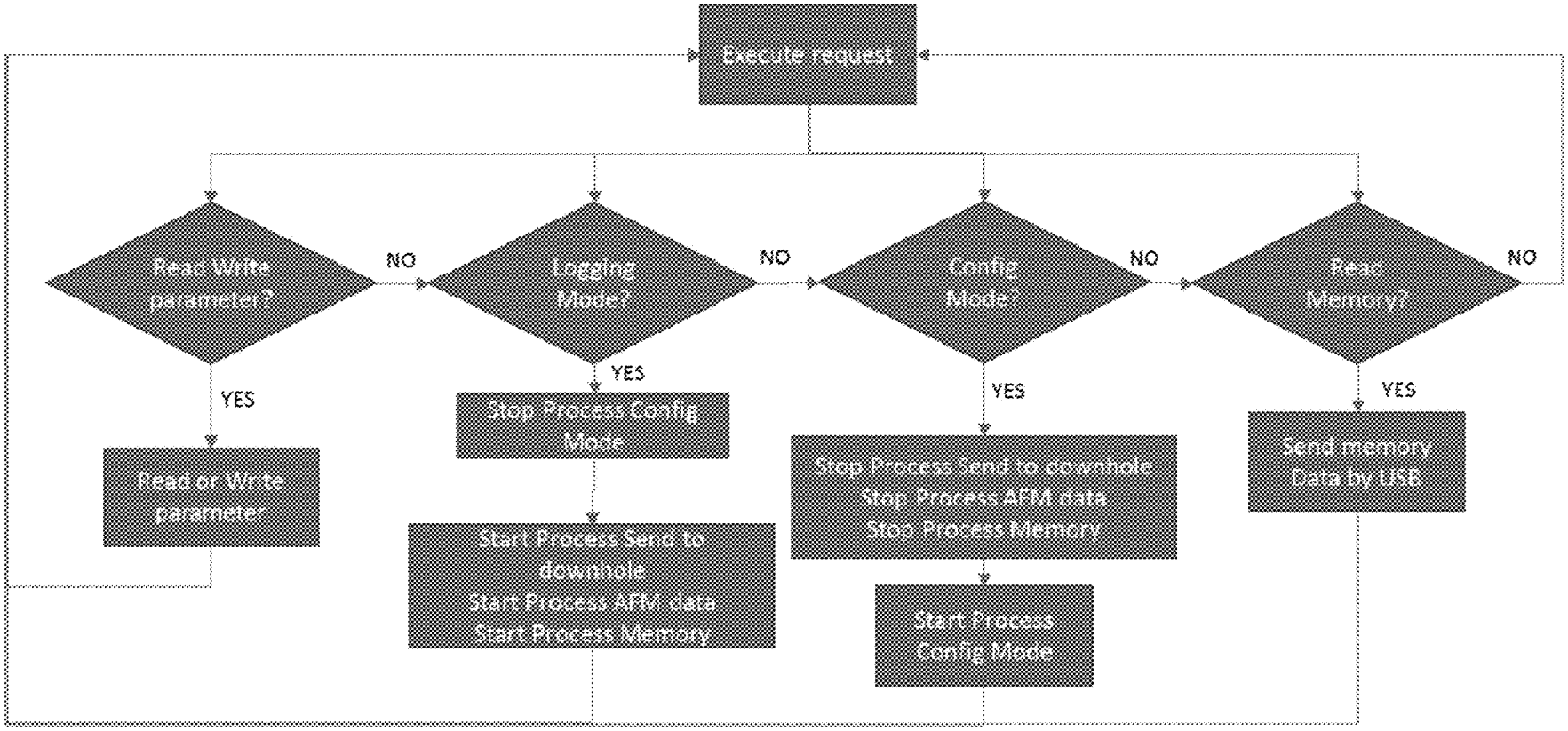
FIG. 13B is a second part of a general flow diagram of the FPGA of the acoustic flow meter tool module.

Referring back to FIG. 8, the electronics module features a main controller 2400 and an FPGA 2500. Practically, the FPGA receives data (i.e., commands) coming directly from the fast hybrid telemetry module 1000 and sends downhole data to the fast telemetry module 1000 for storage or real time transmission through the wireline (5000, not shown). Alternatively, the main microcontroller 2400 may communicate (e.g., bidirectional, data and commands) directly to the FPGA 2400 and the analog front end, transducers firing and timing circuits. Internal communication may suitably be performed through a high-speed serial protocol. In a preferred embodiment, both FPGA 2500 and Microcontroller 2400 perform complex tasks. FIG. 12 is a general flow diagram of the main microcontroller 2400 firmware. FIGS. 13A and 13B are a general flow diagram of the FPGA 2500.

Referring to FIG. 12, the logic for the microcontroller 2400, with variables of "sample time" and "frames to send," may be as follows:

"microcontroller">

"configuration">

"command request?" wherein IF "yes" THEN "change parameter requested" and "Len(Data arra)=!0?" ELSE "no" and "Len(Data arra)=!0?"

"Len(Data arra)=!0?" wherein IF "yes" THEN "take and formatting data and compress" and "frames=B?"

"Frames=B?" wherein IF "yes" THEN "generate data ready flag" and

"Master request data?" or IF "no" THEN "Len(Data arra) =!0?"

"Master request data?" wherein IF "yes" THEN "send compress data by SPI" and "Len(Data arra)=!0?" or IF "no" THEN "sample time interrupt" and "save data on data array" and "Master request data?"

Figure 14:
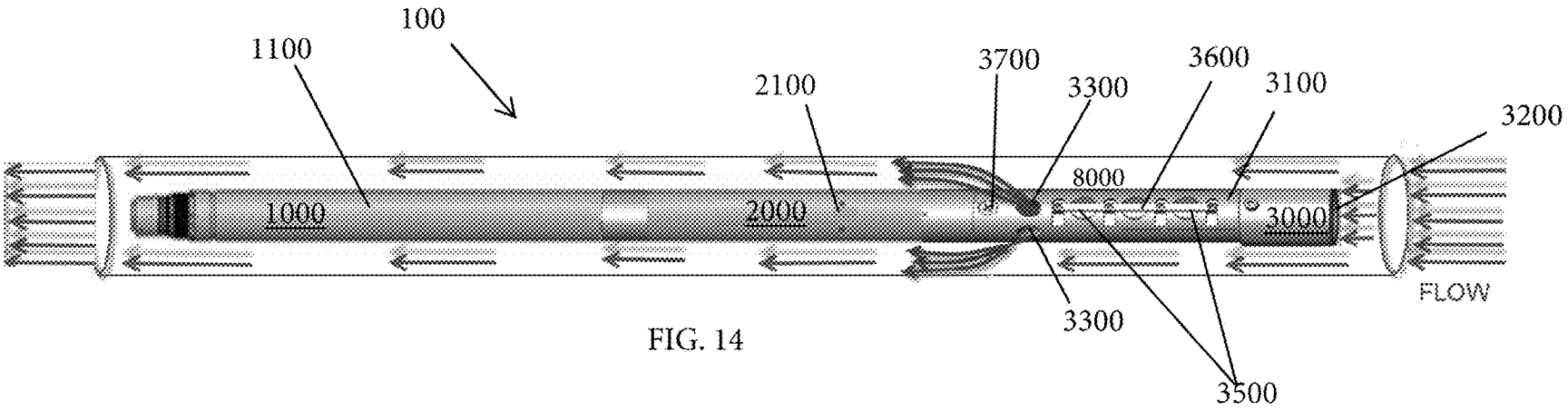
FIG. 14 is an environmental view of the assembly of the fast hybrid telemetry module and acoustic flow meter tool module.

FIG. 14 is a generic environmental view of a downhole tool 100 defined by an assembly of a fast hybrid telemetry module 1000, electronics module 2000, and acoustic flow meter tool module 3000. As shown, the fast hybrid telemetry module 1000, the electronics module 2000, and the acoustic flow meter tool module 3000 are assembled in series, where the acoustic flow meter tool module 3000 defines the upstream (relative to fluid (arrows) moving through a wellbore 8000) end of the downhole tool 100. The depicted downhole tool 100 is generally tubular and configured for downhole placement in a wellbore 8000 with the acoustic flow meter tool module 3000 deposited in the wellbore 8000 first. FIG. 1 generically depicts the structural connectivity of the downhole tool 100. As shown, the fast hybrid telemetry module 1000 may be defined by a substantially fluid tight tubular casing 1100 with internal telemetry and data communication or storage components (not shown); the electronic module 2000 may be defined by a substantially fluid tight tubular casing 2100 with an internal printed circuit board (PCB) (not shown); and the acoustic flow meter tool module 3000 may be defined by an open ended tubular casing 3100 that can accept flowing fluid (arrowed lines) through the open end 3200 as a fluid inlet and discharge the accepted fluid (arrowed lines) through outlet apertures 3300 on the otherwise closed end 3400 of the tubular casing 3100, wherein the acoustic flow meter tool module 3100 internally features two ultrasonic transducers 3500 for measuring the velocity of accepted fluid (arrowed lines), one ultrasonic transducer 3600 for measuring the density of the accepted fluid (arrowed lines), and one temperature sensor 3700 for measuring the temperature of the accepted fluid (arrowed lines) as the fluid (arrowed lines) moves between the inlet end 3200 and outlet apertures 3300 of the open ended tubular casing 3100. Suitably, the downhole tool 100 (i.e., the acoustic flow meter tool module 3000, the electronics module 2000, and the fast hybrid telemetry module 1000)

are mechanically coupled in series via substantially fluid tight and tubular connections 110 to form an extended tubular apparatus.

Figure 15:
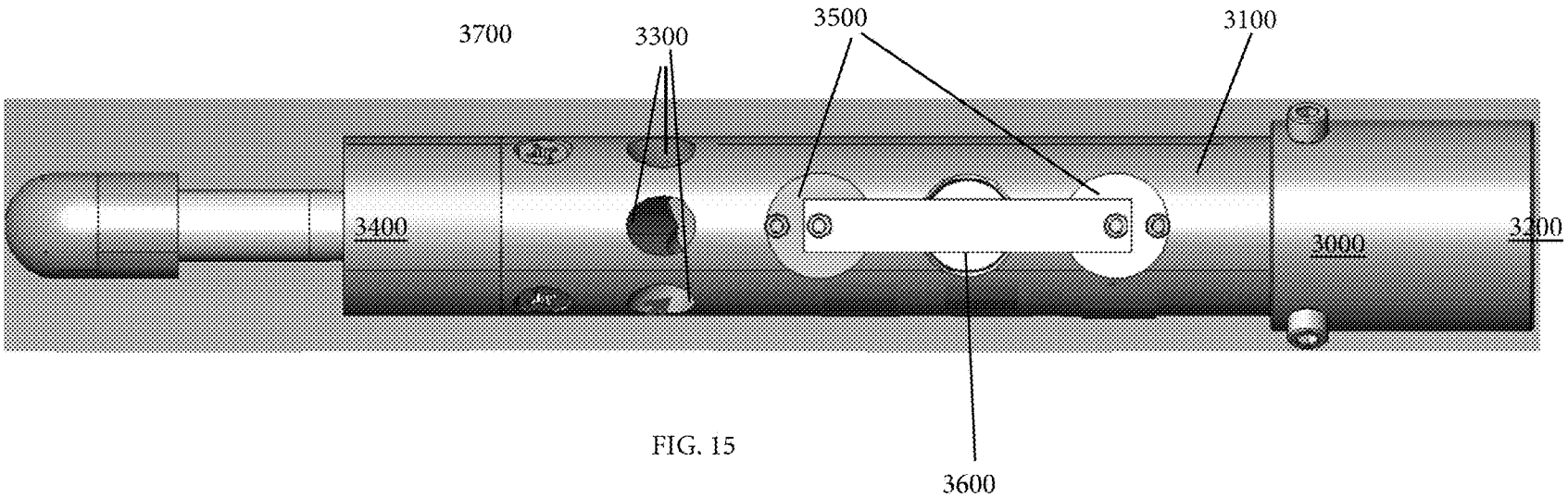
FIG. 15 is a bottom view of the acoustic flowmeter tool module.
Figure 16:
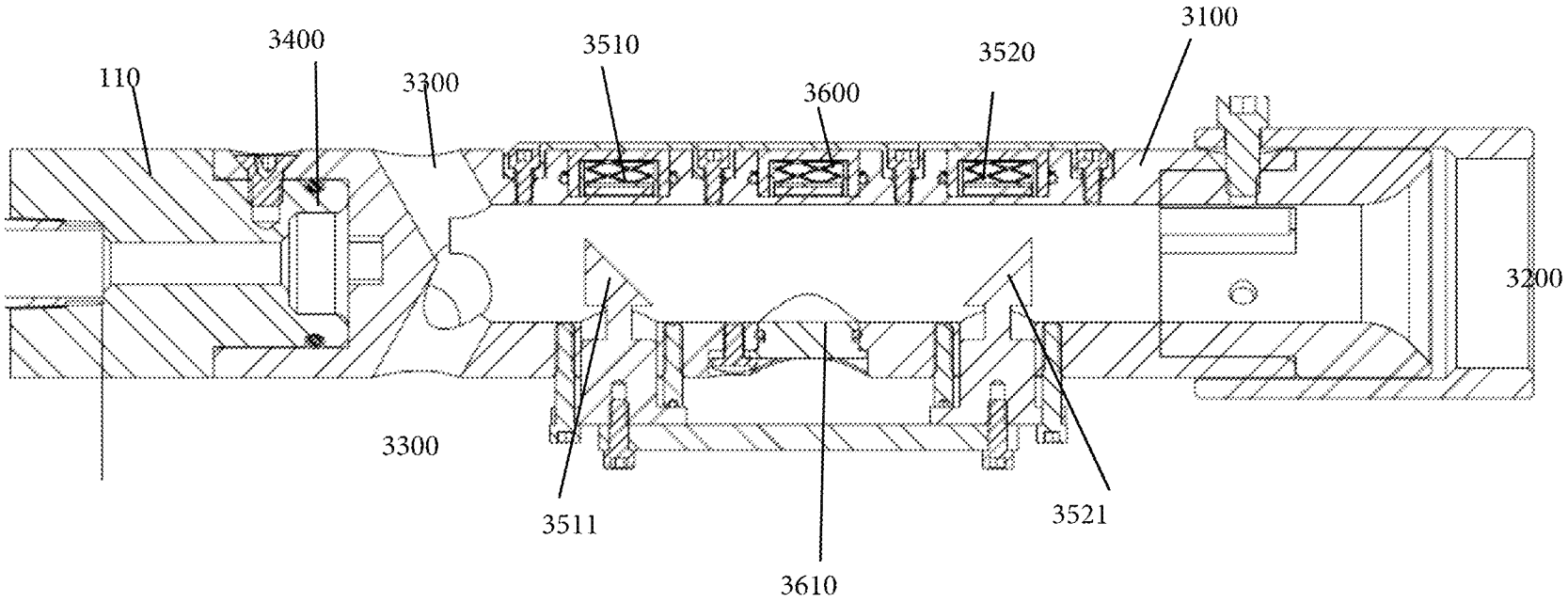
FIG. 16 is a cross section of the acoustic flow meter tool module.
Figure 17:
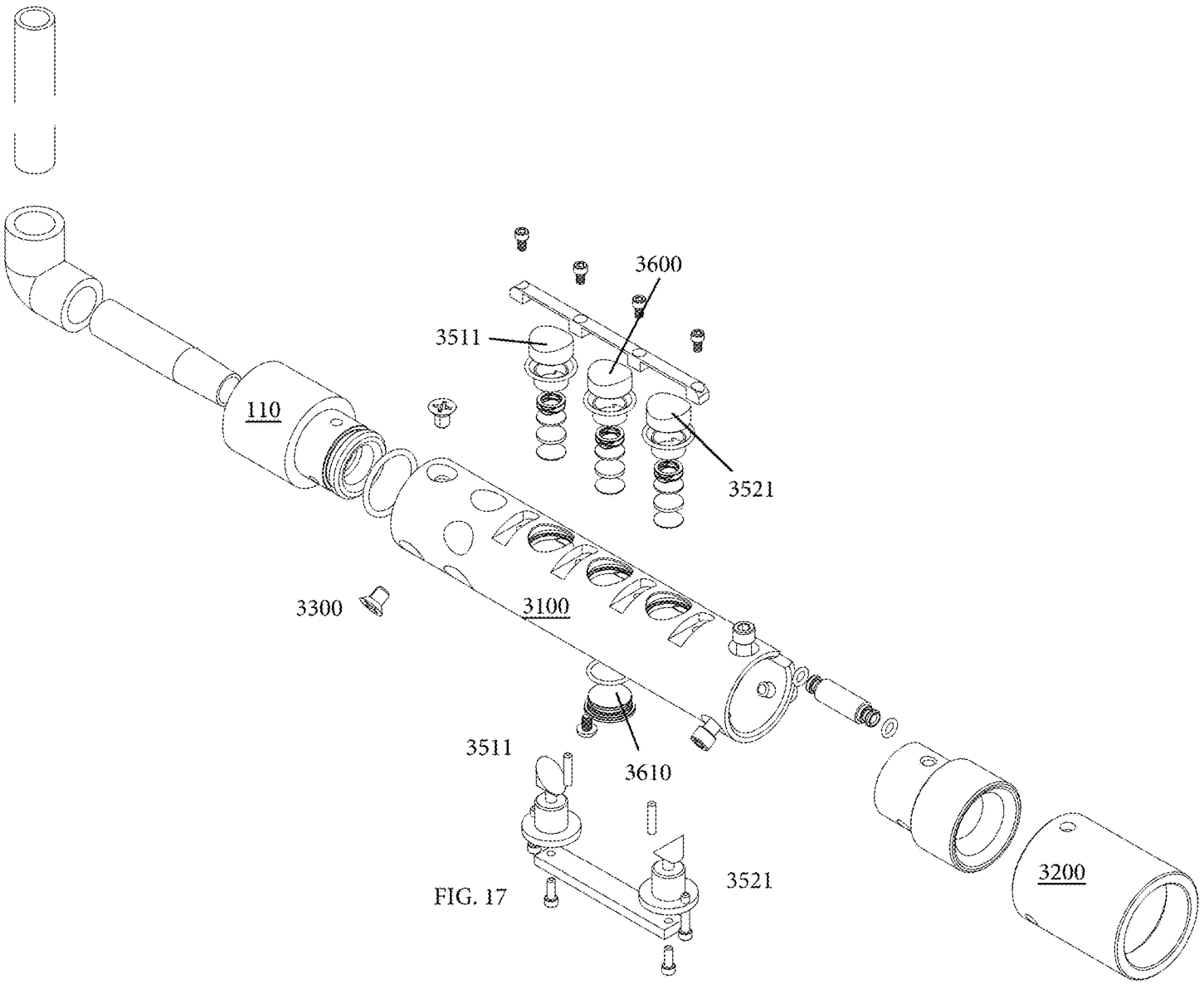
FIG. 17 is an exploded view of the acoustic flow meter tool module.

FIG. 15 is a bottom view of the acoustic flowmeter tool module 3000. FIG. 16 is a cross section of the acoustic flow meter tool module. FIG. 17 is an exploded view of the acoustic flow meter tool module. As shown, the acoustic flow meter tool module 3000 may be defined by an open ended tubular casing 3100 that can accept flowing fluid (not shown) through the open end 3200 as a fluid inlet and discharge the accepted fluid through outlet apertures (3300, not shown) on the otherwise closed end (3400, not shown) of the tubular casing 3100. As is further shown, the acoustic flow meter tool module 3000 internally features two ultrasonic transducers 3510 and 3520 for measuring the velocity of accepted fluid (arrows), one ultrasonic transducer 3600 for measuring the density of the accepted fluid (arrows), and one temperature sensor 3700 for measuring the temperature of the accepted fluid (arrows) as the fluid moves between the inlet 3200 and outlet apertures (not shown) of the open ended tubular casing 3100.

Still referring to FIGS. 15 through 17, the tubular casing 3100 may be a tube with apertures bored out for placement of the ultrasonic transducers (3510 and 3520) at a fixed distance one from the other. Suitably, two other bore holes may be provided opposite the transducers on the tubular casing 3100 for the reflectors (3511 and 3521) so that the same are located in the path of the ultrasonic signals of the transducers (3510 and 3520) to reflect and conduct the wave from one transducer to the other transducer. A third transducer 3600 may be placed in a bore as well opposite to a reflective body 3610 so that the system is installed at a fixed and known distance. Finally, the high sensitivity temperature sensor 3700 may be provided through the casing 3100.

Figure 18:
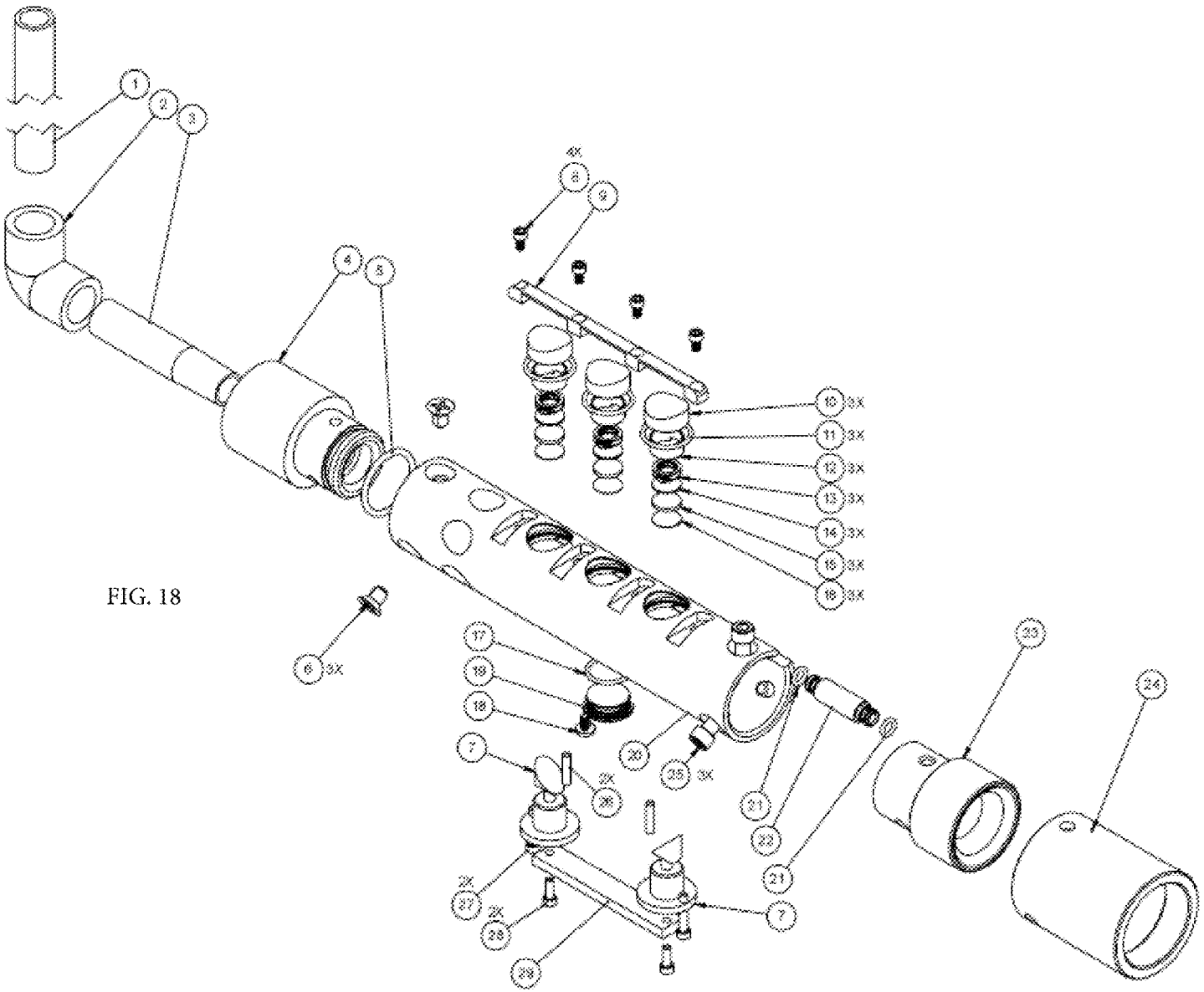
FIG. 18 is an exploded view of the acoustic flow meter tool with a parts designation.

FIG. 18 is an exploded view of the acoustic flow meter tool with a parts designation.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A downhole tool 100 comprising a fast hybrid telemetry module 1000, an electronics module 2000, and an acoustic flow meter tool module 3000:

wherein the fast hybrid telemetry module 1000, the electronics module 2000, and the acoustic flow meter tool module 3000 are assembled in series so that the acoustic flow meter tool module 3000 defines the upstream end of the downhole tool 100;

wherein the fast hybrid telemetry module 1000 may be defined by a substantially fluid tight tubular casing 1100 with internal telemetry and data communication or storage components;

wherein the acoustic flow meter tool module 3000 is provided for regular measurement of fluid temperature, fluid velocity, and fluid density in downhole oilfield production applications;

wherein the acoustic flow meter tool module 3000 is defined by an open ended tubular casing 3100 that can accept flowing fluid through the open end 3200 as a fluid inlet and discharge the accepted fluid through outlet apertures 3300 on the otherwise closed end 3400 of the tubular casing, wherein the acoustic flow meter tool module 3000 internally features a first ultrasonic transducer 3510 and a second ultrasonic transducer 3520 two ultrasonic transducers for measuring the velocity of accepted fluid, one a third ultrasonic transducer 3600 for measuring the density of the accepted fluid, and one temperature sensor 3700 for measuring the temperature of the accepted fluid as the fluid moves between the inlet end and outlet apertures of the open ended tubular casing;

wherein the tubular casing 3100 features a first set of three (3) bores wherein are placed the first ultrasonic transducer 3510, the second ultrasonic transducer 3520, and the third ultrasonic transducer 3600;

wherein the tubular casing 3100 features a second set of three (3) bores that are on an opposite side of the tubular casing of the first set of three bores (3), wherein the second set of three (3) bores are placed a first reflector 3511, a second reflector 3521, and a third reflector 3610 so that (i) the first reflector and second reflector are located in a path of a first acoustic wave, (ii) the first reflector and second reflector are located in a path of a second acoustic wave, and (iii) the third reflector is located in a path of a third acoustic wave;

wherein the outlet apertures 3300 are defined by a third set of bores through the tubular casing 3100, where each bore within the third set of bores is defined at an oblique angle relative to a central axis of the tubular casing 3100;

wherein the electronics module 2000 is provided for data processing and self-compensation of the acoustic flow meter tool module 3000;

wherein the electronic module may be defined by a substantially fluid tight tubular casing 2100 with an internal printed circuit board (PCB);

wherein the acoustic flow meter tool module 3000, the electronics module 3000, and the fast hybrid telemetry module 1000 are mechanically coupled in series via substantially fluid tight and tubular connections to form an extended tubular apparatus;

wherein the fast hybrid telemetry module 1000 is configured for bidirectional data transmission between the downhole tool 100 and a surface data acquisition and monitoring station;

wherein the acoustic flow meter tool module 3000 measures: fluid temperature via a the temperatures sensor 3700; fluid velocity via measurements of (a) an the first acoustic wave traveling with the flow of the fluid being received at one of either the first transducer 3510 or the second transducer 3520 and (b) an the second acoustic wave traveling against the flow of the fluid being reflected and received at the other one of the first transducer 3510 or the second transducer 3520; and fluid density via measurement of an the third acoustic wave traveling across the flow of the fluid being received at the third transducer 3600;

where one of the first or second acoustic waves has a configurable periodicity of twenty five (25) to one-hundred (100) mS;

where the measurements of fluid temperature, fluid velocity, and fluid density are then processed in the electronics module 2000 via programming on the PCB;

where the measurements of fluid temperature, fluid velocity, and fluid density and processing by the electronics module enable accurate and resolute data acquisition over a wide range of fluid velocities between the velocities between one-hundredth (0.01) and fifty (50) mS;

where data is communicated to the fast hybrid telemetry module 1000 and either stored for extraction at a later date or transmitted to the above ground surface data acquisition, control, and monitoring station.

* * * * *